United States Patent [19]

Shoji et al.

[11] Patent Number: 4,888,523

[45] Date of Patent: Dec. 19, 1989

[54] DRIVING CIRCUIT OF THIN MEMBRANE EL DISPLAY APPARATUS

[75] Inventors: Kazuo Shoji; Yosihide Fujioka; Shigeyuki Harada; Toshihiro Ohba, all of Nara, Japan

[73] Assignee: Sharp Kabushiki Kaisha, Osaka, Japan

[21] Appl. No.: 332,450

[22] Filed: Apr. 3, 1989

Related U.S. Application Data

[63] Continuation of Ser. No. 76,219, Jul. 22, 1987, abandoned.

[30] Foreign Application Priority Data

Jul. 22, 1986 [JP] Japan ..... 61-173328
Jul. 29, 1986 [JP] Japan ..... 61-179626
Nov. 27, 1986 [JP] Japan ..... 61-283515

[51] Int. Cl.[4] ..... H01J 19/14

[52] U.S. Cl. ..... 315/169.3; 315/169.2; 340/781; 340/825.81

[58] Field of Search ..... 315/169.3, 169.2, 107; 340/781, 825.81

[56] References Cited

U.S. PATENT DOCUMENTS 4,070,663 1/1978 Kanatani et al. ..... 340/324 M
4,234,821 11/1980 Kako et al. ..... 315/169.3
4,349,816 7/1982 Miller et al. ..... 340/781
4,633,141 12/1986 Weber ..... 315/307
4,636,789 1/1987 Yamaguichi et al. ..... 340/805
4,652,872 3/1987 Fujita ..... 340/781
4,686,426 8/1987 Fujioka et al. ..... 315/169.3
4,707,692 11/1987 Higgins et al. ..... 340/805

FOREIGN PATENT DOCUMENTS 2149182 6/1985 United Kingdom ..... 340/781
2158982 11/1985 United Kingdom .

*Primary Examiner*—Robert L. Griffin
*Assistant Examiner*—T. Salindong
*Attorney, Agent, or Firm*—Birch, Stewart, Kolasch & Birch

[57] ABSTRACT

The present invention relates to a driving circuit of a thin film electroluminescent (EL) display, wherein a high withstand-voltage driver IC composed of a bi-directional switching element having push/pull function is connected with one or both of the scanning electrodes and the data electrodes of EL display, the bi-directional switching circuit for applying the writing voltage or the modulation voltage is applied with the pull up common line of each of the drivers IC and the pull down common line, a switch for extremely recovering, after the thin film EL element has emitted its light, the electric charge accumulated on the thin film EL display element, and a capacitor for accumulating the drawn out electric charge are disposed in the bi-directional switching circuit, and the modulation accumulation electric charge accumulated on the film EL display element after the light emission is accumulated on the capacitor, so that the modulation consumption power occupying the majority of the driving power without the damages to the conventional advantages may be reduced by 25% as compared with the conventional driving.

17 Claims, 10 Drawing Sheets

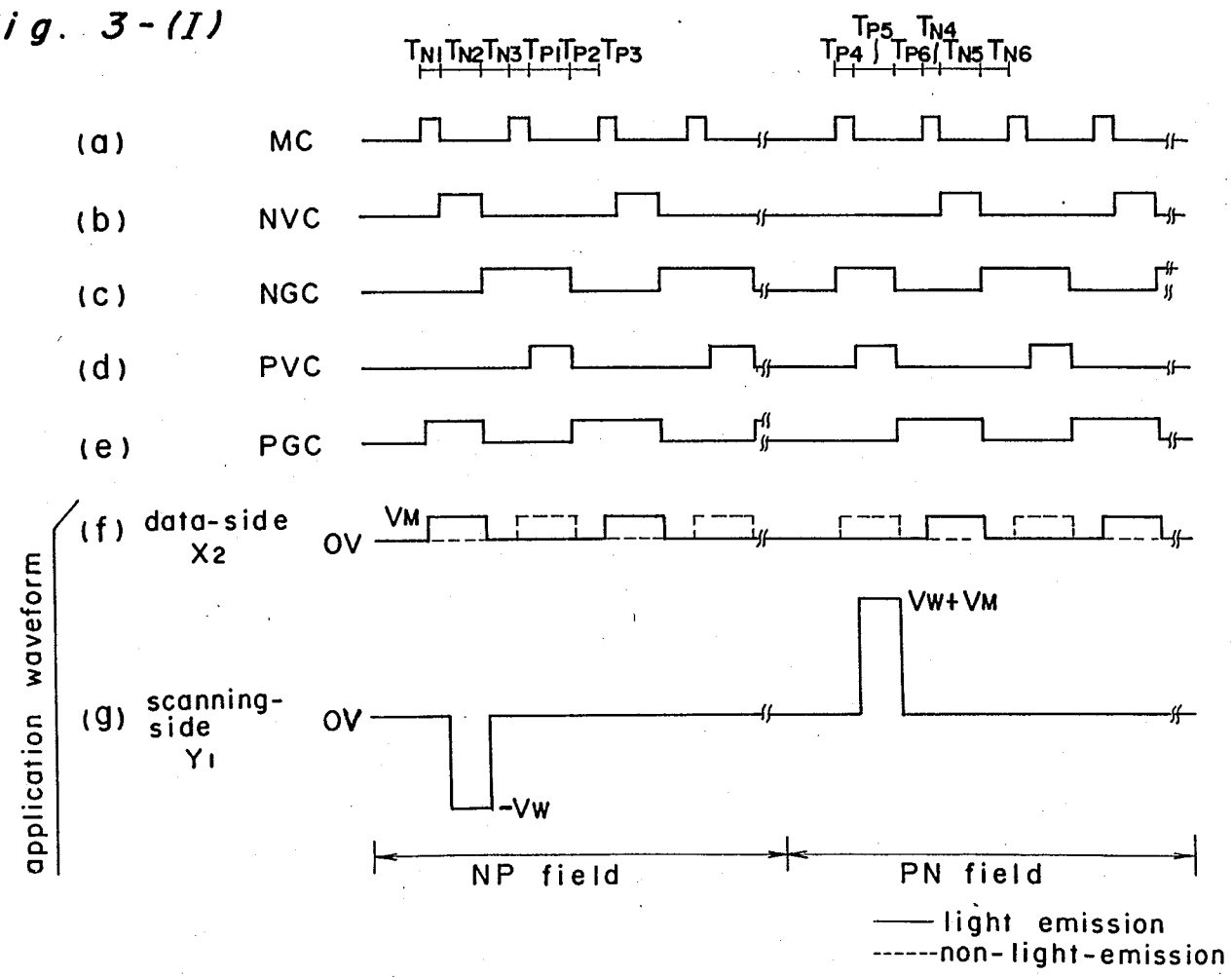
Fig. 3-(I)

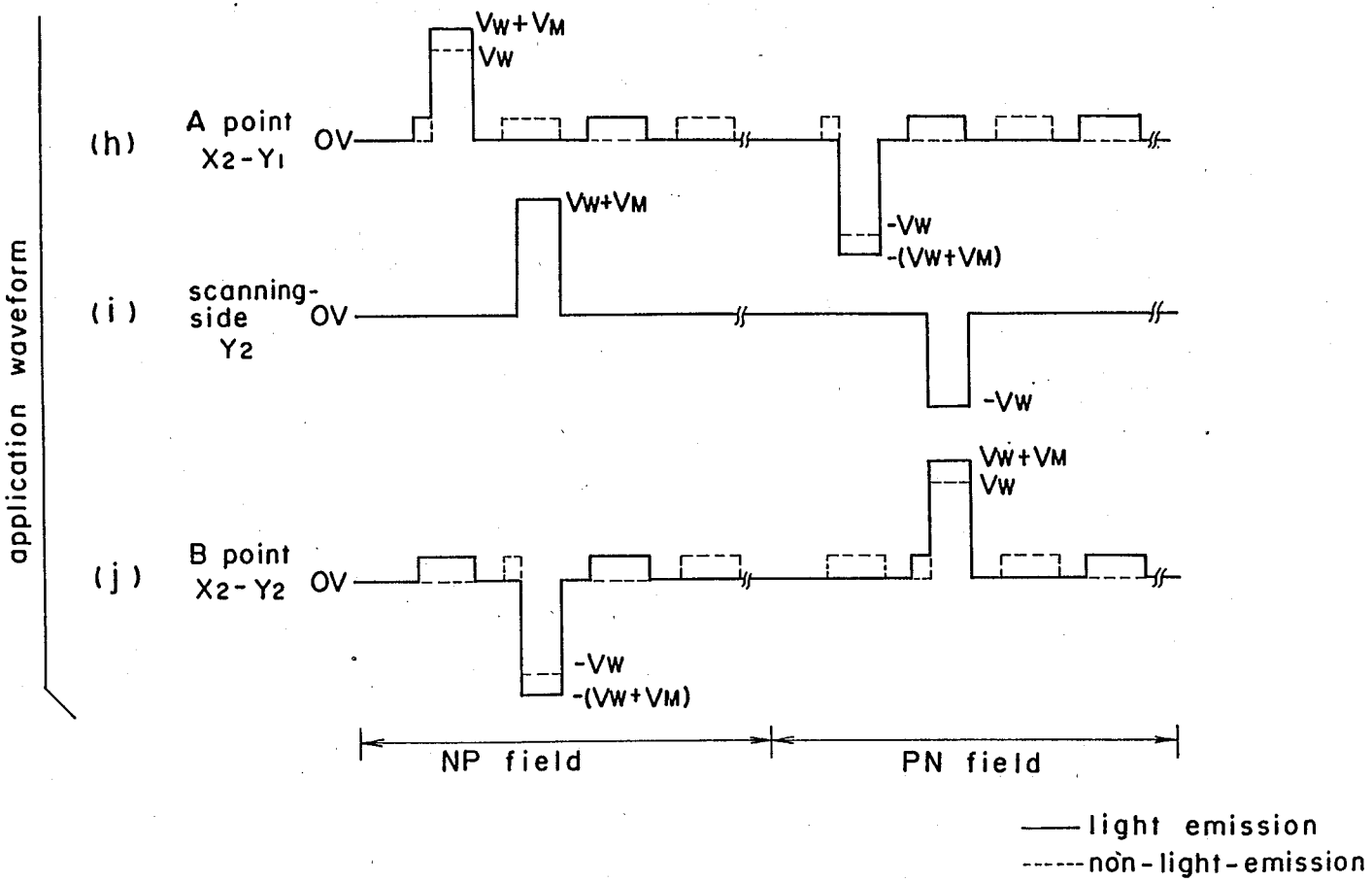
Fig. 3-(III)
(h)
A point
X2-Y1
OV
Vw+VM
Vw
-Vw
-(Vw+VM)
(i)
scanning-side
Y2
OV
Vw+VM
-Vw
(j)
B point
X2-Y2
OV
Vw+VM
Vw
-Vw
-(Vw+VM)
NP field
PN field
application waveform
light emission
non-light-emission Fig. 7-(I)
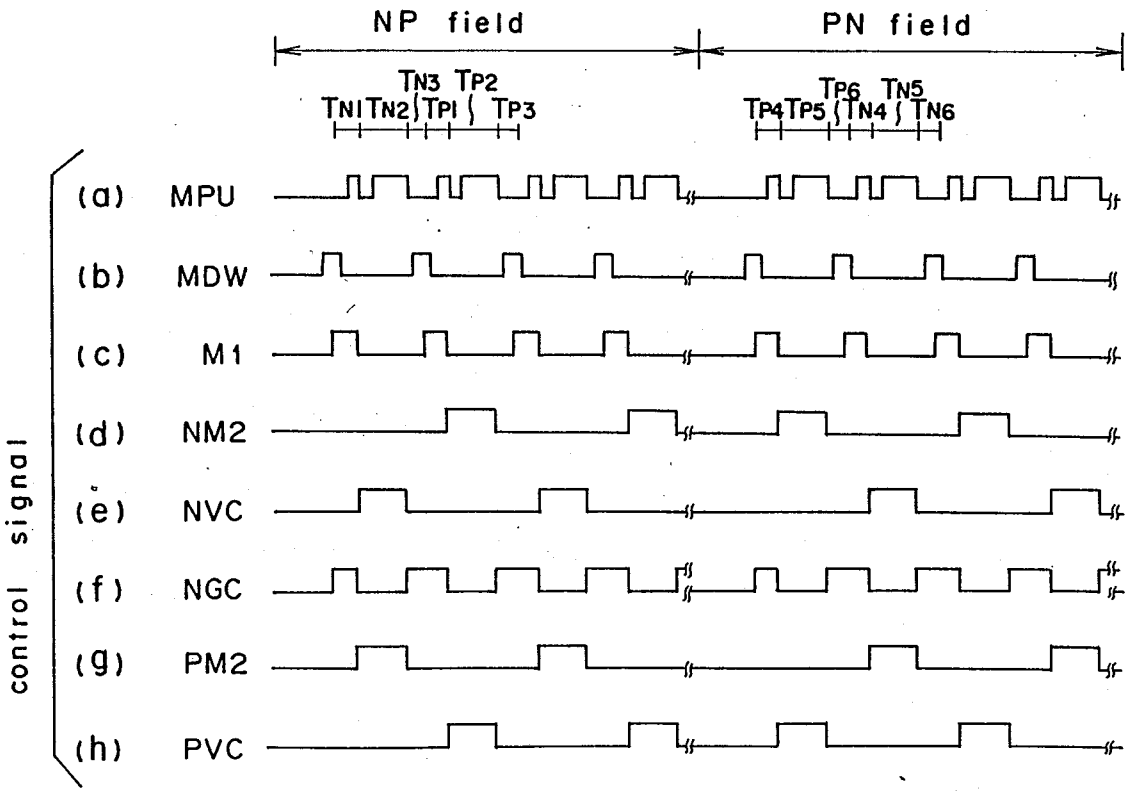

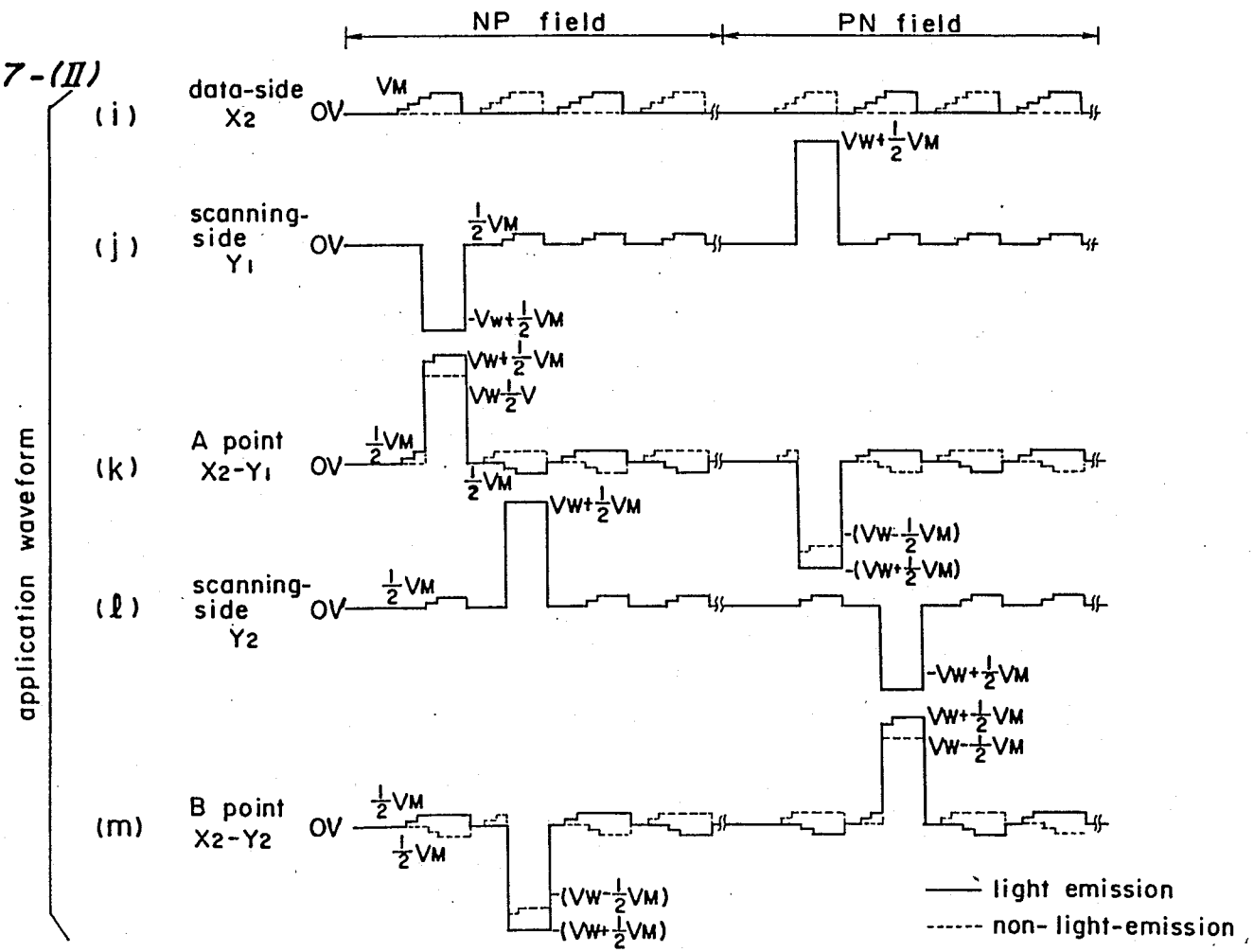
Fig. 7-(II)
application waveform

Fig. 10(a) charging
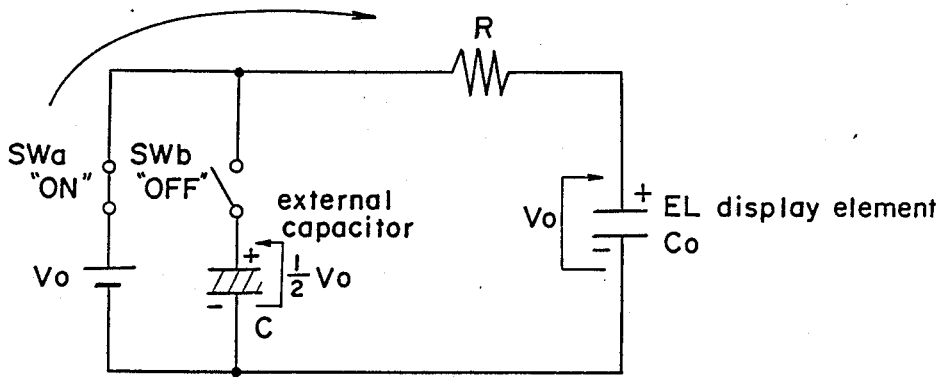
Fig. 10(b) recovery
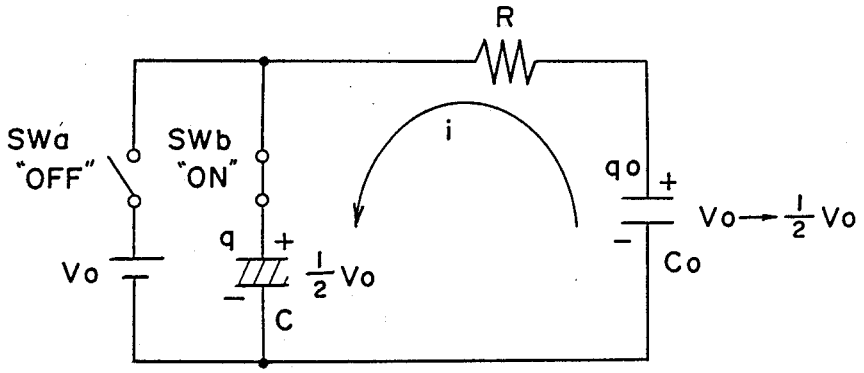

DRIVING CIRCUIT OF THIN MEMBRANE EL DISPLAY APPARATUS

This application is a continuation of application Ser. No. 07/076,219 filed on July 22, 1987, now abandoned.

BACKGROUND OF THE INVENTION

The present invention generally relates to a driving circuit of an AC driving type capacitive flat/matrix display panel, i.e., thin film EL (electro/luminescence) display.

Conventionally, for example, a double insulating type (or three-layer construction) thin film EL element is, for instance, constructed as shown in FIG. 4. Referring to FIG. 4, band-shaped transparent electrodes 2 made of $In_2O_3$ are provided in parallel on a glass base plate 1.A dielectric material 3 such as $Y_2O_3$, $Si_3N_4$, $Al_2O_3$ or the like, an EL layer 4 made of ZnS with activator such as Mn or the like doped therein, and dielectric material layer 3' of $Y_2O_3$, $Si_3N_4$, $TiO_2$, $Al_2O_3$ or the like are sequentially laminated in a film membrane thickness of 500 through 10000 Å into the three-layer construction by the use of a thin film art such as an evaporation method, or a sputtering method. Band-shaped rear-face electrodes 5 made of $Al_2O_3$ are then disposed thereon in parallel in the direction normal to the transparent electrodes 2.

As the thin film EL display has the EL material 4 grasped between the dielectric materials 3, 3', and in turn between the electrodes, it may be considered the capacitive element in terms of an equivalent circuit. Also, the thin film EL element is driven through the application of the comparatively high voltage of about 200 V as clear from the voltage-brightness characteristics shown in FIG. 5. The thin film EL element emits light with high brightness due to application of an AC electric field and exhibits a longer service life.

Conventionally, the switching circuit which discharges the modulation voltage $\frac{1}{2}$ $V_M$ of $\frac{1}{2}$ into the charging diode and the 0V is connected with each electrode on the data side for such film EL display panel. The Nch MOS driver and the Pch MOS driver are provided as the driving circuit for the scanning-side electrode to perform the field inversion driving operation. Furthermore, the driving circuit for reversing the polarity of the storing waveform to be supplied to the picture element for each of scanning lines, the Pch high-withstand voltage MOS driver for charging the modulation voltage $V_M$ with respect to the EL layer, and the Nch high withstand voltage MOS driver for discharging it into the 0V are connected with each of the data-side electrodes in accordance with the increase in the number of the scanning-side electrodes, so that the driving circuit for performing the charging, discharging operations of the modulation voltage at the same time in accordance with the display data in the data-side electrode during the storing driving operation are proposed.

However, in these propositions, two driver ICs (Nch high withstand-voltage MOS driver IC, Pch high withstand-voltage MOS driver IC and so on) or more were required for one line of the scanning electrode. Also, in order to apply the positive, negative high-voltage pulse into the scanning side electrode, the respective control signals of the Nch high withstand-voltage MOS driver and the Pch high withstand-voltage MOS driver were floated, thus requiring the isolator for each control signal use and the respective floating power supplies (interface circuit for driver control signal use), so that the EL driving apparatus was prevented from becoming thinner, more compact, and lower in price.

SUMMARY OF THE INVENTION

An object of the present invention is to provide a driving circuit which may be made thinner, more compact in size and lower in cost.

The present invention provides a driving circuit of a thin film EL display panel, wherein the EL layers are disposed among the scanning-side electrodes and the data-side electrodes arranged in the mutually crossing directions, wherein a first, and a second switching circuits to be described later include first, second high withstand-voltage driver ICs which have push/pull functions and are controlled by a logic circuit, such as shift register, gate or the like, of the single electric-potential, the first switching circuit being applied the negative polarity of voltage and the positive polarity of voltage with respect to the data-side electrode which is connected with each of the scanning-side electrodes, a third switching circuit which switches into the negative polarity of writing voltage and a ground voltage (0V) is connected with the common line for pull down use of the first high withstand-voltage driver IC in the first switching circuit, a fourth switching circuit which switches into the positive polarity of writing voltage and the 0V is connected with the common line for pull up use, the second switching circuit which the charging operation, discharging operation of the modulation voltage with respect to the EL layer corresponding to the scanning-side electrode is connected with each of the data-side electrodes, the common line for pull down use of the second high withstand-voltage driver IC in the second switching circuit is connected with the 0V, a fifth switching circuit which switches the common line into the floating level and the modulation voltage $V_M$ is connected with the common line for pull up use.

The use of the high withstand-voltage driver IC having the push/pull function in accordance with such construction as described hereinabove simplifies the interface circuit of the control signals to be inputted into the scanning-side driver and reduces the driver cost per line in the scanning electrode.

Also, another object of the present invention is to provide a driving circuit by which the apparatus may be made thinner, more compact and cost-lower, and the consumption power during the modulation may be considerably reduced.

The present invention provides a driving circuit of a thin film EL display panel wherein the EL layers are disposed among the scanning-side electrodes and the data-side electrodes arranged in the mutually crossing directions, wherein a first, second switching circuits to be described later include high withstand-voltage drivers IC which have push/pull functions, are controlled by the logic circuit, such as shift register, gate or the like, of the single electric-potential, the first switching circuit which applied the negative polarity of voltage and the positive polarity of voltage with respect to the data-side electrode is connected with each of the scanning-side electrodes, a third switching circuit which switches into the negative polarity of writing voltage, $\frac{1}{2}$ modulation voltage and the zero volt (0V) is connected with the common line for pull down use of the high withstandvoltage driver IC in the first switching circuit, a fourth switching circuit which switches into the positive polarity of writing voltage and the $\frac{1}{2}$ modulation voltage is connected with the common line for pull up use, the second switching circuit which the charging operation, discharging operation of the ½ modulation voltage with respect to the EL layer corresponding to the scanning-side electrode is connected with each of the data-side electrodes, the common line for pull down of the high withstand-voltage driver IC in the second switching circuit is connected with the 0V, a fifth switching circuit which switches the common line into the floating level and the ½ modulation voltage is connected with the common line for pull up use, a sixth switching circuit which splits and ½ modulation voltage to feed it with steps is connected with the switching circuit for feeding the third, fourth, fifth ½ modulation voltage.

The use of the high withstand driver IC having the push/pull function in accordance with such construction as described hereinabove may simplify the interface circuit of the control signal to be inputted into the scanning side and reduce the modulation consumption power considerably.

A further object of the present invention is to provide a driving circuit of a thin film EL display panel by which the modulation consumption power of the thin film EL display panel and the storing power consumption may be considerably reduced.

The present invention provides a driving circuit of a thin film EL display panel wherein EL layers are disposed among the scanning-side electrodes and the data-side electrodes arranged in the mutually crossing directions, wherein a high withstand-voltage driver IC which is composed of a bi-directional switching element having push/pull functions is connected with both or one of the scanning-side electrode and the data-side electrode, a bi-directional switching circuit for applying the writing voltage or the modulation voltage is connected with the pull up common line of each of the drivers IC and the pull down common line, a switch for externally drawing out, after the light-emission of the thin film display element, the electric charge accumulated upon the thin film EL display element, and a capacitor for accumulating the drawn-out electric charge are provided in the bi-directional switching circuit.

The positive polarity of writing voltage or modulation voltage is applied by the bi-directional switching circuit upon the pull up common line of the high withstand-voltage driver IC connected with the scanning-side electrode of the thin film EL display film or the negative polarity of writing voltage, the modulation voltage or the 0V is applied by the bi-directional switching circuit upon the pull down common line. On the other hand, the modulation voltage is applied by the bi-directional switching circuit upon the pull up common line of the high withstand-voltage driver IC connected with the data-side electrode. Also, the pull down common line has the discharging operation effected upon the 0V by the bidirectional switch. The thin film EL display panel has AC pulses applied thereto emit the light. The switching operation is effected to externally draw out the electric charge accumulated on the thin film EL element after the emission of the light. The electric charge accumulated on the thin film EL element is drawn out and is accumulated on the capacitor. Accordingly, the driving power of the thin film EL display panel may be reduced.

BRIEF DESCRIPTION OF THE DRAWINGS

These and other objects and features of the present invention will become apparent from the following description taken in conjunction with the preferred embodiments thereof with reference to the accompanying drawings, in which;

FIGS. 3-(I) and 3-(II) are time charts for illustrating the operation of FIG. 1;

FIG. 7 is a time chart for illustrating the operation of FIG. 6;

FIGS. 10(*a*) and 10(*b*) show recovery circuit model views of the driving circuit.

DETAILED DESCRIPTION OF THE INVENTION

Figure 1:
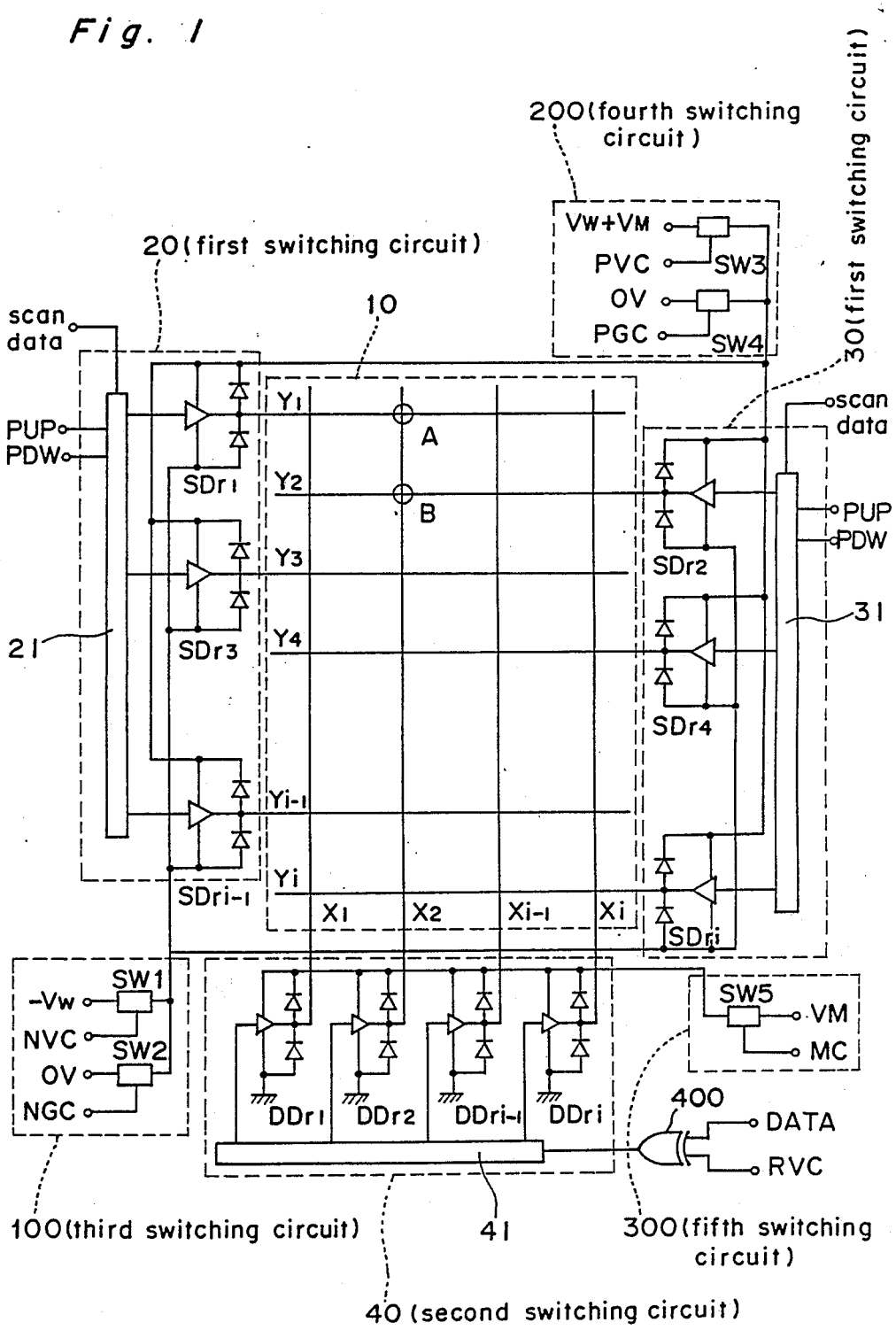
FIG. 1 is an electric circuit diagram showing a first embodiment of the present invention.

Before the description of the present invention proceeds, it is to be noted that like parts are designated by like reference numerals throughout the accompanying drawings.

EMBODIMENT 1

Figure 2A:
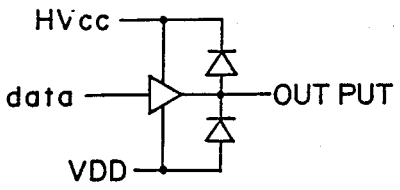
FIGS. 2(*a*) and 2(*b*) show one construction example of a push pull type of driver.
Figure 2B:
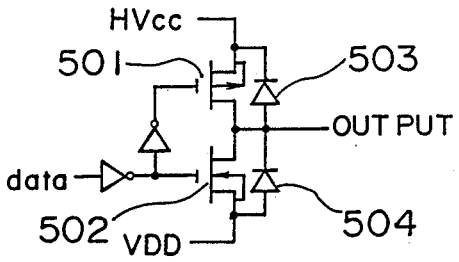

Referring now to the drawings, there is shown in FIG. 1, a driving circuit block diagram showing a first embodiment of the present invention. In FIG. 1, reference character 10 shows the thin film EL display panel of a light-emitting threshold voltage Vth ($V_W < Vth < V_W + V_M$). In this drawing, only the one set of electrodes is shown with the X-direction electrode as a data-side electrode, and the Y-direction electrode as a scanning-side electrode Scanning-side high withstand voltage push pull type driver IC (which are equivalent to a first switching circuit) 20, 30 respectively correspond to the odd-number line and, the even-number line of the Y direction electrode. Logical circuits 21, 31 (shift registers) in the respective scanning-side drivers IC 20, 30 are adapted to produce a condition where the pull up or pull down element is turned on in accordance with the scan data in the shift register by the control signals such as scan data, PUP, PWD, etc., a condition where all the pull up or pull down element is turned on independently of the scan data. Reference numeral 40 is a data-side high withstand voltage push pull type driver IC (which is equivalent to a second switching circuit) corresponding to the X-direction electrode. Reference numeral 41 is a logical circuit of the shift registers of the data-side driver IC 40. One construction example of the push pull type driver shown in FIG. 2(*a*) is shown in FIG. 2(*b*). Reference numeral 501 is a Pch high withstand voltage MOSFET for the pull up use. Reference numeral 502 is a Nch high withstand voltage MOSFET for the pull down use. Reference numerals 503, 503 are diodes for flowing the current in the direction opposite to each FET. The FETs 501, 502 are turned on, or off by the circuits of the level shifters in accordance with the input data. No problems are caused when the push pull type driver is composed of the switching element having a pull up function and the switching element having a pull down function.

A circuit 100 (equivalent to a third switching circuit) which switches the pull-down common line electric-potentials of the scanning-side drivers 20, 30 is composed of switches SW1, SW2 that are changed over into the negative-polarity writing voltage $-V_W$ and 0V by the control signals NVC, NGC.

A circuit 200 (equivalent to a fourth switching circuit) which switches the pull up common line electric-potentials of the scanning-side drivers 20, 30 is composed of switches SW3, SW4 that are changed over into the positive-polarity writing voltage $V_W+V_M$ and 0V by the control signals PVC, PGC.

A circuit 300 (equivalent to a fifth switching circuit) which switches the pull up common line electric potentials of the data-side driver 40 is composed of switches SW5 that is changed over into the modulation voltage $V_M$ and the floating condition by the control signal MC.

Reference numeral 400 is a data inversion control circuit.

The operation of FIG. 1 will be described hereinafter with reference to the time chart of FIG. 3.

Assume that the scanning electrode of $Y_1$ including the picture element A and $Y_2$ including the picture element B is selected by the linear sequential driving operation. Also, in this driving apparatus the driving operation is effected through the inversion of the polarity of the writing voltage to be applied upon the picture element for each of one lines. The driving timing of the one line, where the MOSFET for the pull down use of the high withstand voltage drivers IC 20, 30 connected with the scanning-side selection electrode is turned on to apply the negative storing pulse upon the picture element on the electrode line, is called the N drive timing, the driving timing of one line, where the MOSFET for the pull up use is turned on to apply the positive storing pulse on the electrode line is called the P drive timing. Also, a field (picture face), where the P drive is carried out with respect to the even line with the N driving operation being performed with respect to the scanning-side odd-numbered line, is called the NP field, the field opposite to it is called the PN field.

(A) NP field

1. Modulation Voltage Charging Period ($T_{N1}$) in the N Driving

The Pch MOSFET of all the drivers $SD_{r1}$ through $SD_{ri}$ on the scanning side is turned on, the switch SW4 is turned on by the control signal PGC to keep all the electrodes on the scanning side. At the same time, the switch SW5 is turned on by the control signal MC. The drivers $DD_{r1}$ through $DD_{ri}$ on the data side turn on the Pch MOSFETs corresponding to display elements which are to exhibit light emission in accordance with the display data signal and turn on the Nch MOSFETs corresponding to display elements of the non-light-emission. When the display data signal is "H" with the light emitted, "L" with no light emitted, the input display data logic as it is required to be inputted into the driver IC 40, so that the signal RVC in the data inversion control circuit 400 is kept "L". (However, the driver IC is "H" with Pch MOSFET on, "L" with Nch MOSFET off. Also, as the linear sequential driving operation is effect, the display data is being transferred during the front line driving operation and is retained by the latch.) Thus, the modulation voltage $V_M$ is charged on the data side on the light emitted picture element only. After the completion of the charging operation, the switch SW5 is turned off.

2. Storing Period ($T_{N2}$) in the N Driving

As the pull down common line electric potential of the scanning-side for all the drivers $SD_{r1}$ through $SD_{ri}$ is turned into the negative polarity of writing voltage $-V_W$, the switch SW1 is turned on into the control signal NVC. At the same time, only the odd-number scanning side driver 20 is turned on in accordance with the data of the shift register. Only the driver which is connected with the selection scanning electrode has the Nch MOSFET turned on, the others have the Pch MOSFET turned on. On the other hand, the even-number scanning side driver 30 and the data side driver 40 connect the driving operation during the $T_{Ni}$ period. Thus, the $V_M-(-V_W)=V_W+V_M$ is applied upon the light emitting picture element to emit the light. Also, the $0V-(-V_W)=V_W$ is applied upon the non-light-emission, but the light does not emit as the voltage is the light emission threshold voltage Vth or lower.

3. Discharge Period ($T_{N3}$) in the N Driving

After the switch SW1 has been turned off by the control signal NVC, the switch SW2 is turned on by the control signal NGC and at the same time the Nch MOSFET of all of the scanning-side drivers are turned on. Thus, the writing voltage is discharged so that all the scanning electrodes become zero volt (0V).

4. Modulation Voltage Charging Period ($T_{P1}$) in the P Driving

The Nch MOSFET of all the drivers $SD_{r1}$ through $SD_{ri}$ on the scanning side is turned on to turn on the switch SW2 by the control signal NGC to retain the electric potential of all of the scanning-side electrodes at the 0V. At the same time, the switch SW5 is turned on by the control signal MC. The drivers $DD_{r1}$ through $DD_{ri}$ on the data side turn on the Nch MOSFET in the case of the light emission, turn on the Pch MOSFET in the case of the non-light emission in accordance with the reverse signal of the display data. As the reverse signal of the input display data is required to be inputted into the driver IC40, the signal RVC in the data inversion control circuit 400 is maintained "H". Thus, the modulation voltage VM is charged on the data side only on the non-light-emission picture element The switch SW5 is turned off when the charging operation is completed.

5. Storing Period ($T_{P2}$) in the P Driving

In order to make the pull up common line electric potential of the scanning side for all the drivers the positive polarity of writing voltage $V_W+V_M$, the switch SW3 is turned on by the control signal PVC. At the same time, only the even-number scanning side driver 30 is turned on in accordance with the data of the shift register. Only the driver which is connected with the selection scanning electrode has the Pch MOSFET turned on, the others have the Nch MOSFET turned on. On the other side, the odd-numbered canning side driver 20 and the data side driver 40 continue the driving operation of the $T_{P1}$ period. The $(V_W+V_M)-0V=V_W+V_M$ is applied upon the light emission picture element to emit the light. Also although the $(V_W+V_M)-V_M=V_W$ is applied upon the non-light-emission picture element, the light is not emitted as the voltage is the light emission threshold voltage Vth or lower.

6. Discharging Period ($T_{P3}$) in the P Driving

After the switch SW3 has been turned off by the control signal PVC, the switch SW4 is turned on by the control signal PGC and simultaneously the Pch MOSFET of the scanning-side all the drivers are turned on. Then, the writing voltage is discharged, so that all the scanning electrodes become 0V.

(B) PN Field

1. Modulation Voltage Charging Period ($T_{P4}$) in the P Driving

The driving operation similar to that of the modulation voltage charging period ($T_{P1}$) in the NP field P driving operation is effected.

2. Storing Period ($T_{P5}$) in the P Driving

The selection election on the scanning side is selected from the odd-number side, the even-number side driver 30 performs the driving operation similar to that of the storing period ($T_{P2}$) in the NP field P driving except for the connecting operation of the driving of the $T_{P4}$ period.

3. Discharging Period ($T_{P6}$) in the P Driving

The driving operation similar to that of the discharging period $T_{P3}$ in the NP field P driving is effected.

4. Modulation Voltage Charging Period ($T_{N4}$) in the N Driving

The driving operation similar to that of the modulation voltage charging period ($T_{N1}$) in the NP field N drive is effected.

5. Storing Period ($T_{N5}$) in the N Driving

The selection electrode on the scanning side is selected from the even-number side, the odd-numbered-side driver 20 performs the driving operation similar to that of the storing period ($T_{N2}$) in the NP field N drive except for the connecting operation of the driving of the modulation voltage charging period ($T_{N4}$) in the PN field N driving.

6. Discharging Period ($T_{N6}$) in the N Driving

The driving operation similar to that of the discharging period ($T_{N3}$) in the NP field N driving is effected.

As described hereinabove, in this driving circuit, it is composed of the driving timing of the NP field and the PN field. In the NP field, the N driving is performed with respect to the even-number selection line on the scanning side, the P driving is performed with respect to the even-numbered selection line, in the PN field, the driving operation opposite to it is performed to close the AC pulses necessary with respect to all the picture elements of the thin film EL display panel. FIG. 3 shows as a representative example the voltage waveform to be applied upon the picture elements A, B.

In the driving circuit, the pull up and the pull down of the output-stage drivers are controlled by the single shift register and the driver control signal, but in the conventional driving circuit, the shift register for the pull-up control use, and the control signal, the shift register for the pull-down control use, and the control signal are required, also to apply the positive and negative high voltage pulses upon the scan electrode, both the control signals have to be floated. However, in the push pull type high withstand voltage driver, the floating control signal becomes one second of the conventional one, which leads to the reduction of the interface circuit for the driver control signal use, thus resulting in the cost reduction. Also, in the conventional driving circuit, the high withstand-voltage driver per one line in the scanning electrode required two or more, but the push pull type high withstand-voltage driver requires one, thus resulting in considerable cost reduction and thin type compact.

As is clear from the first embodiment, according to the arrangement of the present invention, the interface circuit of the control signals to be inputted into the scanning side driver is simplified by the use of the high withstand voltage driver having the pull up function and the pull down function. As the driver cost per line in the scanning electrode is reduced, the considerable cost reduction may be performed as the entire apparatus, so that the driving circuit for thin type/compact thin film EL display panel may be provided.

EMBODIMENT 2

Figure 6:
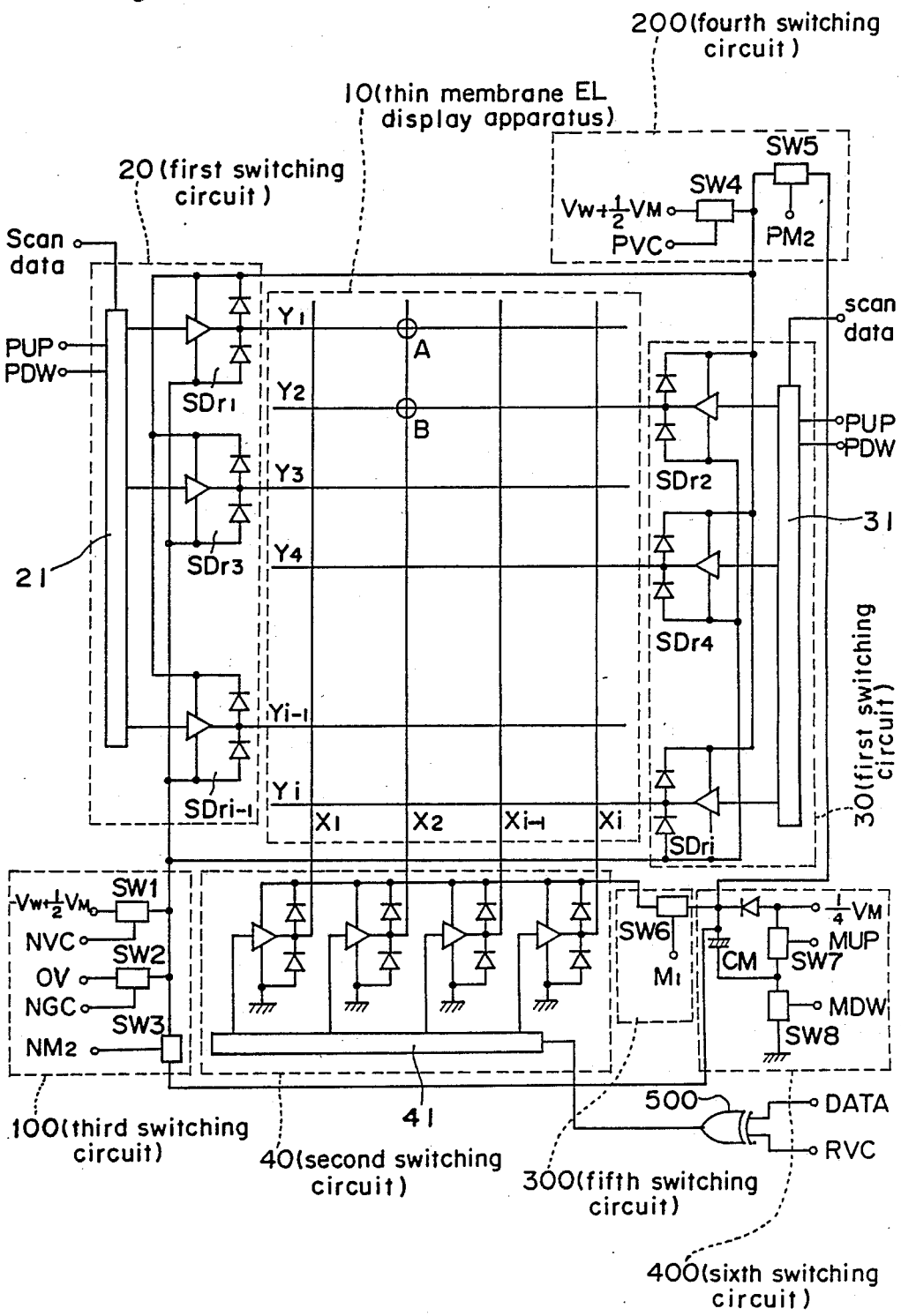
FIG. 6 is an electric circuit diagram showing a second embodiment of the present invention.

There is shown in FIG. 6, a driving circuit blocK diagram showing a second embodiment of the present invention. In FIG. 6, the components which are the same as those in the first embodiment of FIG. 1 are designated by like reference numerals. The different points between the second embodiment shown in FIG. 6 and the first embodiment shown in FIG. 1 are as follows. Reference numeral 10 is a thin film EL display panel of light emission threshold voltage Vth $(V_W-\frac{1}{2}V_M<Vth<V_W+\frac{1}{2}V_M)$. In this drawing, only the electrodes are shown with the X-direction electrode as the data-side electrode, the Y-direction electrode as the scanning-side electrode.

Reference numeral 100 is a circuit for switching (equivalent to a third switching circuit) the pull down common line electric-potential of the scanning side drivers 20, 30. The circuit is composed of switches SW1, SW2, SW3, which are changed into the negative polarity of writing voltage $-V_W+\frac{1}{2}V_M$, modulation voltage $\frac{1}{2}V_M$, and 0V by the control signals NVC, NGC, NM2.

Reference numeral 200 is a circuit for switching (equivalent to a fourth switching circuit) the pull up common line electric potential of the scanning-side drivers 20, 30. The circuit is composed of switches SW4, SW5 which are changed over into the positive-polarity of writing voltage $V_W+\frac{1}{2}V_M$ and the modulation voltage $\frac{1}{2}V_M$ by the control signals PVC, PM2.

Reference numeral 300 is a circuit for switching (equivalent to a fifth switching circuit) the pull up common line electric potential of the data-side driver 40. The circuit is composed of a switch SW6 which is changed over into the modulation voltage $\frac{1}{2}V_M$ and the floating condition by the control signal M1.

Reference numeral 400 is a circuit (equivalent to a sixth switching circuit) for feeding the modulation voltage of $\frac{1}{2}V_M$ after the application of the modulation voltage of $\frac{1}{4}V_M$ through the turning on of the switch SW8 by the control signal MDW, thereafter the turning on of the switch SW8, the turning on the switch SW7 by the control signal MUP. The circuit is connected with the switches SW3, SW5, SW6 which are controlled by the control signals M1, NM2, PM2.

Reference numeral 500 is a data inversion control circuit.

The operation of FIG. 6 will be described hereinafter with reference to the time chart of FIG. 7.

Assume that the scanning electrode of $Y_1$ including the picture element A and $Y_2$ including the picture element B have been selected by the linear subsequent driving operation. Also, in the driving apparatus, the driving operation is effected through the inversion of the polarity of the writing voltage to be applied upon the picture element per line. The driving time per line, where the MOSFET for pull down use of the high withstand drivers IC 20, 30 connected with the scanning side selection electrode is turned on, the negative storing pulse is applied upon the picture element on the electrode, is called the N drive timing, while the driving timing per line, where the MOSFET for pull up use is turned on and the positive storing pulse is applied upon the picture element on the electrode line, is called the P drive timing. Also, a field (picture face), where the N driving is performed with respect to the scanning-side odd-numbered line and the P driving operation is carried out with respect to the even-numbered line, is called the NP field. The field opposite to it is called PN field.

(A) NP Field

1. First Modulation Voltage Charging Period ($T_{N1}$) in The N Driving

The Nch MOSFET of all the drivers $SD_{r1}$ through $SD_{ri}$ on the scanning side is turned on, the switch SW2 is turned on by the control signal NGC to maintain all the electrodes on the scanning side 0V. At the same time, the switch SW6 is turned on by the control signal M1. At this time, the drivers $DD_{r1}$ through $DD_{ri}$ on the data side turn on the Pch MOSFET in the case of the light emission in accordance with the display data, and turn on the Nch MOSFET in the case of the non-light-emission. When the display data signal is emitted in light with "H", is not emitted in light with "L", the input display data signal (DATA) as it is required to be inputted into the driver IC40, so that the signal RVC in the data inversion control circuit 500 is kept "L". (In the driver IC, the Pch MOSFET turns on, the Nch MOSFET turns off in the "H", the Pch MOSFET turns off, the Nch MOSFET turns on in the "L". Also, as the linear sequential driving is performed, the display data are transferred at the previous line driving operation, and is retained by the latch.) Here, the modulation voltage of $\frac{1}{4}V_M$ is applied upon the light emission picture element, the switch SW8 is turned on by the control signal MDW to charge the modulation voltage of $\frac{1}{4}V_M$ to the capacitor CM. Then, after the switch SW8 has been turned off by the control signal MDW, the switch SW7 is turned on by the control signal MUP to apply the modulation voltage of $\frac{1}{2}V_M$ upon the light emission picture element. Accordingly, the first modulation voltage $\frac{1}{2}V_M$ is charged onto the data side with steps on the light emission picture-element only, but is not charged upon the non-light-emission picture element, so that the data side electrode electric-potential is maintained 0V. After the completion of the charging operation, the switches SW6, SW7 are turned off.

2. Second Modulation Voltage Charging and Storing Period ($T_{N2}$) in the N Driving Only the driver connected with the selection scanning electrode turns on the Nch MOSFET, the other scanning side drivers turn on the Pch MOSFET. At the same time, the modulation voltage of $\frac{1}{4}V_M$ is applied upon the pull up common line of the scanning-side for all the drivers IC 20, 30 by the control signal PM2 with the switch SW5 on. Thereafter, the switch SW7 is turned on by the control signal MUP to apply the modulation voltage of $\frac{1}{2}V_M$. Also, the switch SW1 is turned on by the control signal NVC to apply the negative polarity of writing voltage $-V_M+\frac{1}{2}V_M$ upon the pull down common line. On the other hand, the data-side driver 40 continues the driving operation of the first modulation voltage charging period ($T_{N1}$) in the N driving.

As the modulation voltage of $\frac{1}{2}V_M$ is charged on the data side onto the light emission picture-element during the first modulation voltage charging period ($T_{N1}$) in the N driving, the data-side electrode electric-potential becomes $V_M$. As the negative polarity of writing voltage $-V_M+\frac{1}{2}V_M$ is applied upon the selection scanning-side electrode, $V_M-(-V_W+\frac{1}{2}V_M)=V_N+\frac{1}{2}V_M$ is applied to emit the light. Also, the non-light-emission picture element is 0V in the dataside electrode electric-potential, the negative polarity of writing voltage $-V_W+\frac{1}{2}V_M$ is applied upon the selection scanning-side electrode, so that $0V-(-V_M+\frac{1}{2}V_M)=V_W-\frac{1}{2}V_M$ is applied upon the non-light-emitted picture element. As the voltage is the light-emission threshold value voltage $V_{th}$ or lower, the light does not light.

3. Discharging Period ($T_{N3}$) in the N Driving

After the switches SW1, SW5, SW7 have been turned off by the control signals NVC, PM2, MUP, the switch SW2 is turned on by the control signal NGC and simultaneously the Nch MOSFET of the scanning-side for all the drivers is turned on. Thus, the writing voltage and the second modulation voltage are discharged, so that all the scanning electrodes become 0V.

4. First Modulation Voltage Charging Period ($T_{P1}$) In the P Driving

The Nch MOSFET of all the drivers $SD_{r1}$ through $SD_{ri}$ on the scanning side in turned on. The switch SW2 is kept on by the control signal NGC to keep all of the scanning-side electrodes 0V in electric potential. At the same time, the switch SW6 is turned on by the control signal M1. At this time, the drivers $DD_{r1}$ through $DD_{ri}$ on the data side turn on the Nch MOSFET in the case of the light emission in accordance with the inversion signal of the display data signal, turn on the Pch MOSFET in the case of the non-light-emission. As the inversion signal of the input display data signal (DATA) is required to be inputted into the driver IC40, the signal RVC in the data inversion control circuit 500 is kept "H". Also, the modulation voltage of $\frac{1}{4}V_M$ is applied upon the non-light-emission picture element, the switch SW8 is turned on by the control signal MDW to charge the modulation voltage of $\frac{1}{4}V_M$ into the capacitor $C_M$. After the switch SW8 has been turned off by the control signal MDW, the switch SW7 is turned on by the control signal MUP to apply the modulation voltage of $\frac{1}{2}V_M$ upon the non-light emission picture element. At this time, the charging operation is not effected onto the light emission picture-element, so that the data-side electrode electric-potential becomes 0V. Thus, the modulation voltage $\frac{1}{2}V_M$ is charged with steps on the data side into the non-light-emission picture element only. After the completion of the charging operation, the switches SW6, SW7 are turned off.

5. Second Modulation Voltage Charging and Storing Period ($T_{P2}$) in the P Driving Only the driver connected with the selection scanning electrode has the Pch MOSFET turned on, the other scanning-side drivers have the Nch MOSFET turned on. At the same time, the switch SW4 is turned on by the control signal PVC on the pull up common line of the scanning-side of all the drivers IC20, 30 to apply the positive polarity of writing voltage $V_W+\frac{1}{2}V_M$. Also, the switch SW3 is turned on by the control signal NM2 on the pull down common line to apply the modulation voltage of $\frac{1}{4}$ $V_M$. Thereafter, the switch SW8 is turned on by the control signal MUP to apply the modulation voltage of $\frac{1}{2}$ $V_M$ with steps. On the other hand, the data-side driver 40 continues the driving operation of the first modulation voltage charging period ($T_{P1}$) in the P driving.

The light-emission picture-element has the positive polarity of writing voltage $V_W+\frac{1}{2}V_M$ applied upon the selection scanning electrode, so that the data-side electrode electric-potential is 0V. The $(V_W+\frac{1}{2}V_M)-0V=V_W+\frac{1}{2}V_M$ is applied upon the light-emission picture element to emit the light. Also, as the non-light-emission picture element has the modulation voltage of $\frac{1}{2}V_M$ charged onto the data side during the first modulation voltage charging period ($T_{P1}$) in the P driving, the data-side electrode electric-potential becomes $V_M$. As the positive polarity of writing voltage $V_W+\frac{1}{2}V_M$ is applied upon the selection scanning-side electrode, $(V_W+\frac{1}{2}V_M)-V_M=V_W-\frac{1}{2}V_M$ is applied upon the non-light-emission picture element. But, as the voltage is the light-emission threshold value voltage Vth or lower, the light is not emitted.

6. Discharging Period ($T_{P3}$) in the P Driving

After the switches SW3, SW4, SW7 have been turned off by the controls signals NM2, PVC, MUP, the switch SW2 is turned on by the control signal NGC to turn on the Nch MOSFET of all of the scanning-side drivers at the same time. Thus, the writing voltage and the second modulation voltage is discharged, so that all the scanning electrodes become 0V.

(B) PN Field

1. First Modulation Voltage Charging Period ($T_{P4}$) in the P Driving

The driving operation similar to the first modulation voltage charging period ($T_{P1}$) in the NP field P driving is effected.

2. Second Modulation Voltage Charging and Storing Period ($T_{P5}$) in the P Driving The driving operation similar to the second modulation voltage charging and storing period ($T_{P2}$) in the NP field P driving is effected.

3. Discharging Period ($T_{P6}$) in the P Driving

The driving operation similar to that of the discharging period ($T_{P3}$) in the NP field P driving is effected.

4. First Modulation Voltage Charging Period ($T_{N4}$) in the N Driving

The driving operation similar to the first modulation voltage charging period ) in the NP field N driving is effected.

5. Second Modulation Voltage Charging and Storing Period ($T_{N5}$) in the N Driving The driving operation similar to the second modulation voltage charging and storing period ($T_{N2}$) in the NP field N driving is effected.

6. Discharging Period ($T_{N6}$) in the N Driving

The driving operation similar to that of the discharging period ($T_{N3}$) in the NP field N driving is performed.

As described hereinabove, it is composed of the drive timing of the NP field and the PN field in the driving circuit. In the NP field, the N drive is carried out with respect to the odd-numbered selection line on the scanning side, the P drive is carried out with respect to the even-numbered selection line, in the PN field, the drive opposite to it is carried out to close AC pulses necessary for the light emission with respect to all the picture elements of the thin film EL display panel. FIG. 7 shows the voltage waveforms, as the representative example, to be applied upon the picture element A, the picture element B.

In the conventional driving circuit, the $V_M$ is charged into the light emitting picture element, but is not charged into the non-light-emission picture element in the N driving. As the charging operation is not performed into the light-emission picture element, but the $V_M$ is charged into the non-light-emission picture element in the P driving, the modulation power consumption does not change with respect to the number of the light emission/non-light emission picture elements. For example, the average modulation power consumption during the driving operation per line in the entire face light-emission condition becomes (the power consumption in the N driving + the power consumption in the P driving) $\div 2=(CV_M^2+0)\div 2=\frac{1}{2}CV_M^2$, where the capacity of all the picture elements is C.

On the other hand, in the driving circuit $\frac{1}{2}$ $V_M$ is charged into both the light emission/non-light emission picture elements in the N driving, $\frac{1}{2}V_M$ is charged into both the light emission/non-light emission picture elements even in the N driving. The average modulation power consumption during the driving operation per line in the entire face light-emission condition becomes [(the power consumption in the N driving + the power consumption in the P driving) $\div 2=\{C(\frac{1}{2}V_M)^2+C(\frac{1}{2}V_M)^2\}\div 2=\frac{1}{4}CV_M^2$].

In the driving circuit, the power is reduced by one half with respect to the modulation power consumption in the conventional driving circuit. Also, the $\frac{1}{2}$ modulation voltage is divided into two steps and is applied, so that it is reduced by three-fourths. Accordingly, it is reduced by three-eighths as a whole.

Also, the scanning-side drivers IC 20, 30 require the withstand voltage of $(V_W+\frac{1}{2}V_M)-\frac{1}{2}V_M=V_W$ in the N driving, require that of $\frac{1}{2}V_M-(-V_W+\frac{1}{2}V_M)=V_W$ even in the P driving. As the voltage to be applied upon the light-emission picture element at this time, the voltage which is applied upon the light-emission picture element may be applied by scanning-side driver IC withstand voltage $(+\frac{1}{2}V_M)$, so that the IC low in the withstand voltage or the thin film EL display panel high in the light emission withstand value voltage may be used.

As is clear from the second embodiment of the present invention, the apparatus may be made thinner, more compact in shape and lower in cost. As the modulation power consumption occupying the most part (about 70%) of the driving power may be reduced as compared with that of the conventional driving, the power consumption may be considerably saved in the entire apparatus. As the high withstand-voltage driver having the pull-up function and the pull-down function is used, the interface circuit of the control signal to be inputted into the scanning-side driver is simplified, the driver cost per line in the scanning electrode is reduced, thus resulting in the considerable cost reduction as the whole apparatus. Accordingly, the driving circuit of the thin film EL display panel which is thinner and more compact may be provided.

EMBODIMENT 3

In the present embodiment, one portion of the modulation energy accumulated in the EL display apparatus by one driving operation is adapted to be accumulated in the outer capacitor for re-using operation. It is to be noted that the re-use may be performed likewise even in the storing energy, but the description thereof in the present embodiment may be omitted.

Figure 8:
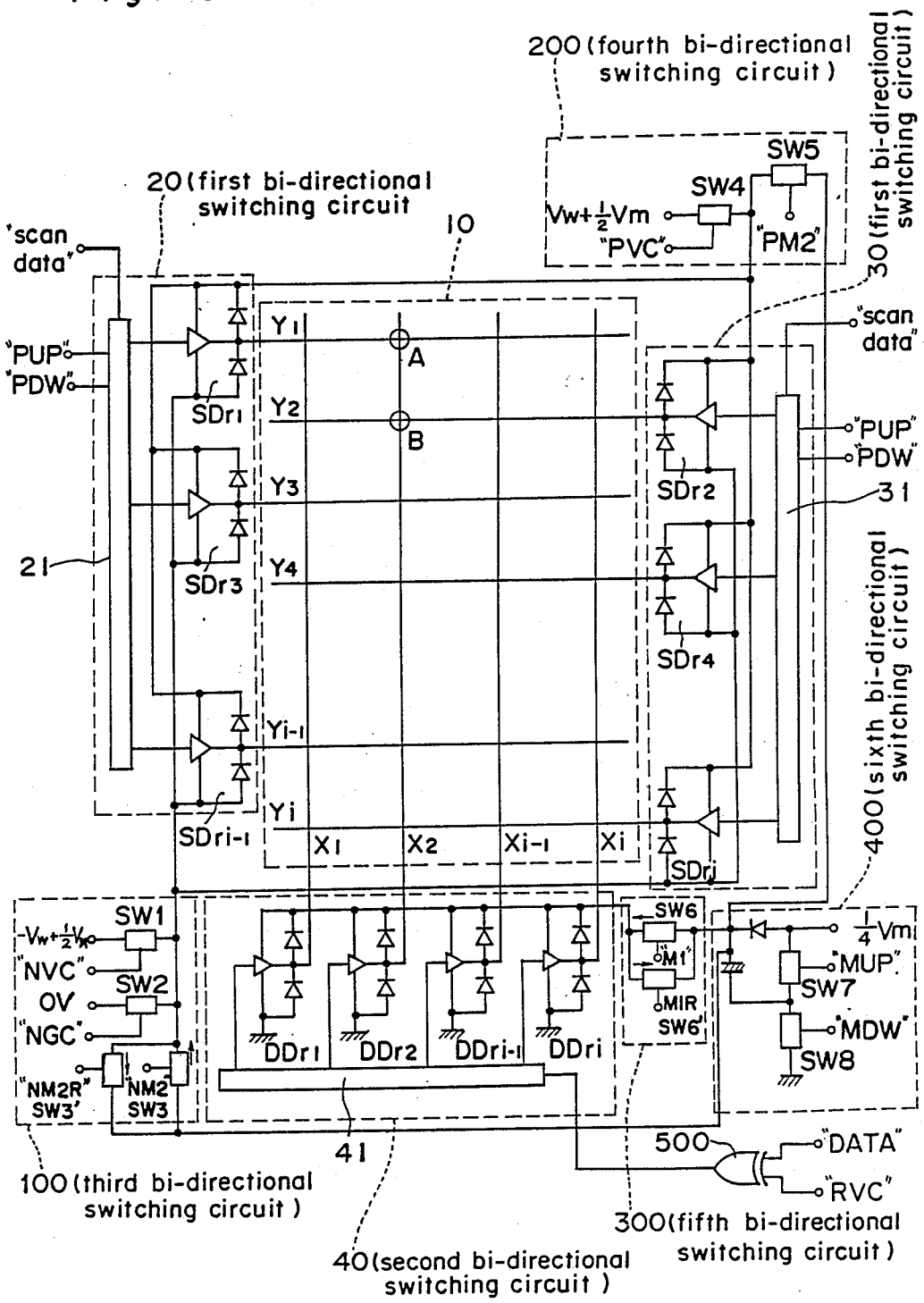
FIG. 8 is a driving circuit diagram of the thin film EL display panel in third embodiment of the present invention.

FIG. 8 is a driving circuit block diagram showing the third embodiment of the present invention.

In FIG. 8, the like parts in the second embodiment of FIG. 6 are designated by like reference numerals for omission of the description. The different points between the third embodiment shown in FIG. 8 and the second embodiment shown in FIG. 6 is as follows. Reference numeral 10 the thin film EL display panel of the light-emission threshold value voltage $Vth(V_W<Vth<V_W+V_M)$. In this drawing, only a set of electrodes is shown with the X-direction electrode as the data side electrode, the Y-direction electrode as the scanning side electrode. Reference numerals 20, 30 are the bilateral drivers IC (are equivalent to the first bi-directional switching circuit, are referred to as scanning-side driver IC hereinafter) of the scanning-side high withstand voltage push-pull corresponding respectively to the odd-number line and the even-number of the Y-direction of the thin film EL display panel 10. Reference numeral 40 is equivalent to the data-side high withstand-voltage push-pull bi-directional driver IC (equivalent to the second bi-directional switching circuit, is referred to as data-side driver IC hereinafter) corresponding to the X-direction electrode of the thin film EL display panel 10.

Reference numeral 100 is a circuit (equivalent to the third bi-direction switching circuit) which switches the pull-down common line electric-potential of the scanningside drivers IC 20, 30. It is composed of switches SW1, SW2, SW3 which are changed over into the negative polarity of writing voltages $-V_W$, 0V, the modulation voltage $\frac{1}{2}V_M$ by the control signals "NVC", "NGC", "NM2", and a switch SW3' which is changed over into the switch SW3 and the opposite direction by the control signal "NM2R".

Reference numeral 200 is a circuit (equivalent to the fourth bi-directional switching circuit) which changes over the pull up common-line electric potential of the scanning-side drivers IC 20, 30, and is composed of switches SW4, SW5 which are changed over into the positive polarity of writing voltage $V_W+V_M$, the modulation voltage $\frac{1}{2}V_M$ by the control signal "PVC", "PM2".

Reference numeral 300 is a circuit (equivalent to the fifth bi-directional switching circuit) which changes over the pull up common-line electric potential of the data-side driver IC 40, and is composed of a switch SW6 which changes over into the modulation voltage $\frac{1}{2}V_M$, the floating condition by the control signal "M1", and a switch SW6' which changes over into the direction opposite to the switch SW6 by the control signal "M1R".

Reference numeral 400 is a circuit (equivalent to the sixth switch circuit) which turns on the switch SW8 by the control signal "MDW" to charge the modulation voltage $\frac{1}{4}V_M$ into the capacitor $C_M$, turns off the switch SW8 after the charging operation, turns on the switch SW7 by the control signal "MUP" to feed the modulation voltage $\frac{1}{2}V_M$ after the feeding operation of the modulation voltage $\frac{1}{4}V_M$ for connection with switches SW3, SW5, SW6 to be controlled by the control signals "NM2", "PM2", "M1". Also, in this circuit, the switch SW3' or the switch SW6' is turned on by the control signal "NM2R" or "M1R", furthermore, the switch SW8 is turned on by the control signal "MDW" to accumulate on the capacitor $C_M$ one portion of the energy accumulated on the EL display apparatus.

The operation of FIG. 8 will be described hereinafter with reference to the time chart of FIG. 9.

Figure 9:
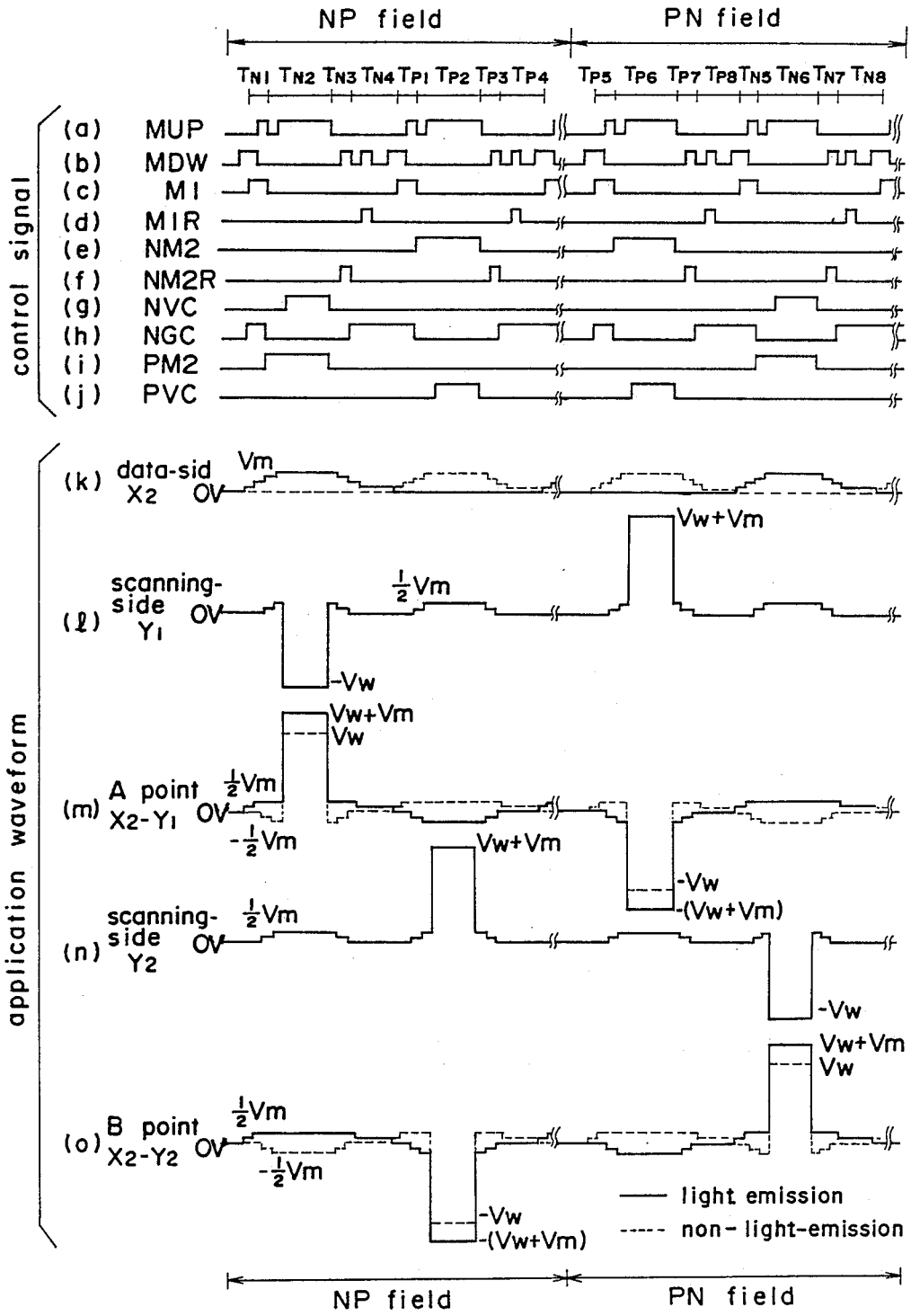
FIG. 9 shows a time chart for illustrating the operation of FIG. 8, and the examples of the voltage waveforms to be applied upon the picture elements.

In FIG. 9, the like parts in the third embodiment are designated by like reference numerals for omission of the description. The different points between the third embodiment and the second embodiment is as follows.

(A) NP Field

1. First Modulation Voltage Charging Period ($T_{N1}$) in the N Driving

The driving operation similar to that of the second embodiment is effected.

2. Second Modulation Voltage Charging and Storing Period ($T_{N2}$) in the N Driving The driving operation similar to that of the second embodiment is effected except the following operation.

The switch SW1 is turned on by the control signal "NVC" to apply the negative polarity of writing voltage $-V_W$ upon the pull down common line of all of the scanning side drivers IC 20, 30. As the negative polarity of writing voltage $-V_W$ is applied upon the selection scanning electrode at the same time, the $V_M-(-V_M)=V_M+V_M$ is applied upon the light-emission picture element to emit the light. Also, the non-light-emission picture element is 0V in the data side electrode potential. As described hereinabove, the negative polarity of writing voltage $-V_W$ is applied upon the selection scanning electrode, so that $0V-(-V_W)=V_W$ is applied upon the non-light-emission. But, as the voltage is the light emission threshold voltage Vth or lower, the light is not emitted.

3. Storing Voltage Discharging and Second Modulation Voltage Recovery Period ($T_{N3}$) in the N Driving After the switches SW1, SW5, SW7 have been turned off by the control signals "NVC", "PM2", "MUP", the Nch MOSFET of all of the scanning-side drivers $SD_{r1}$ through $SD_{ri}$ to discharge the writing voltage, so that all of the scanning-side electrode electric-potentials become $\frac{1}{2}V_M$ Then, the switches SW3', SW8 are turned on by the control signals "NMR2R", "MDW", so that one portion of the electric charge accumulated with the scanning-side electrode as the plus during the second modulation voltage charging period ($T_{N2}$) is accumulated on the capacitor $C_M$. And all the scanning-side electrode electric-potential becomes $\frac{1}{4}V_M$. On the other hand, the electrode electric-potential connected with the light-emission picture element of the data-side electrode becomes $\frac{3}{4}V_M$.

4. Second Modulation Potential Discharging and First Modulation Voltage Recovery Period ($T_{N4}$) in the N Driving After switches SW3', SW8 have been turned off by the control signals "NM2R", "MDW", the switch SW2 is turned on by the control signal "NGC" to turn the scanning-side electrode electric-potential into 0V. Also, the electrode electric-potential connected with the data-side light-emission picture element becomes $\frac{1}{2}V_M$. The switches SW6', SW8 are turned on by the control signals "M1R", "MDW" to accumulate on the capacitor $C_M$ one portion of the electric charge accumulated with the data-side electrode as the plus on the first modulation voltage period ($I_{N1}$). And all of the data-side electrode electric potential becomes $\frac{1}{4}V_M$.

5. First Modulation Voltage Charging Period ($T_{P1}$) in the P Driving

The driving operation similar to that of the second embodiment is effected.

6. Second Modulation Voltage Charging and Storing Period ($T_{P2}$) in the P Driving The data-side driver 40 continues the driving operation of the first modulation voltage charging period ($T_{P1}$) in the P driving.

As the data-side electrode electric-potential is 0V, the second modulation voltage of $\frac{1}{2}V_M$ is charged with steps onto the scanning side upon light-emission picture element. At the same time, the positive polarity of writing voltage $V_W+V_M$ is applied upon the selection scanning electrode, so that the $(V_W+V_M)-0V=V_W+V_M$ is applied upon the light-emission picture element to emit the light. Also, the modulation voltage $\frac{1}{2}V_M$ is charged onto the data side for the first modulation voltage charging period ($T_{P1}$) upon the non-light-emission picture element, so that the data-side electrode electric-potential becomes $V_M$. At the same time, as the positive polarity of writing voltage $(V_W+V_M)-V_M=V_W$ is applied upon the selection scanning electrode, the is applied upon the light-emission picture element. But, as the voltage is the light-emission threshold voltage Vth or less, the light is not emitted.

7. Storing Voltage Discharging and Second Modulation Voltage Recovery Period ($T_{P3}$) in the P Driving After the switches SW4, SW3, SW7 have been turned off by the control signals "PVC", "NM2", "MUP", the Nch MOSFET of the scanning side drivers $SD_{r1}$ through $SD_{ri}$ is turned on to discharge the writing voltage, so that all of the scanning-side electrode electric-potential becomes $\frac{1}{2}V_M$. Then, switches SW3', SW8 are turned on by the control signals "NM2R", "MDW" to accumulate on the capacitor $C_M$ one portion of the electric charge accumulated with the scanning-side electrode as the plus on the second modulation voltage charging period ($T_{P2}$). And all of the scanning electrode electric-potential becomes $\frac{1}{4}V_M$. On the other side, the electrode electric-potential connected with the non-light-emission picture element of the data-side electrode becomes $\frac{3}{4}V_M$.

8. Second Modulation Voltage Discharge and Modulation Voltage Recovery Period ($T_{P4}$) in the P Driving After the switches SW3', SW8 have turned off by the control signals "NM2R", "MDW", the switch SW2 is turned on by the control signal "NGC" to turn the scanning-side electrode electric potential into 0V. Also, the electrode electric potential connected with the data-side non-light-emission picture element becomes $\frac{1}{2}V_M$. The switches SW6', SW8 are turned on by the control signals "M1R", "MDW" to accumulate on the capacitor $C_M$ one portion of the electric charge accumulated with the data-side electrode as the plus for the first modulation voltage period ($T_{P1}$). And all of the data-side electrode electric-potential becomes $\frac{1}{4}V_M$.

(B) PN Field

1. First Modulation Voltage Charging Period ($T_{P5}$) in the P Driving

The driving operation similar to that of the first modulation voltage charging period ($T_{P1}$) in the NP field P driving is effected.

2. Second Modulation Voltage Charging and Storing Period ($T_{P6}$) in the P Driving The driving operation similar to that of the second modulation voltage charging and storing period ($T_{P2}$) in the NP field P driving is effected.

3. Storing Voltage Discharging and Second Modulation Voltage Recovery Period ($T_{P7}$) in the P Driving The driving operation similar to that of the writing voltage discharging and second modulation voltage recovery period ($T_{P3}$) in the NP field P driving is effected.

4. Second Modulation Voltage Discharging and First Modulation Voltage Recovery Period ($T_{P8}$) in the P Driving The driving operation similar to that of the writing voltage discharging and second modulation voltage recovery period ($T_{P4}$) in the NP field P driving operation is effected.

5. First Modulation Voltage Charging Period ($T_{N5}$) in the N Driving

The driving operation similar to that of the first modulation voltage charging period ($T_{N1}$) in the NP field N driving is effected.

6. Second Modulation Voltage Charging and Storing Period ($T_{N5}$) in the N Driving The driving operation similar to that of the second modulation voltage charging and storing period ($T_{N2}$) in the NP field N driving is effected.

7. Storing Voltage Discharging and Second Modulation Voltage Recovery Period ($T_{N7}$) in the N Driving The driving operation similar to that of the writing voltage discharging and second modulation voltage recovery period ($T_{N3}$) in the NP field N driving operation is effected.

8. Second Modulation Voltage Discharging and First Modulation Voltage Recovery Period ($T_{N8}$) in the N Driving The driving operation similar to that of the second modulation voltage discharging and first modulation voltage recovery period ($T_{N4}$) in the NP field N driving is effected.

As described hereinabove, it is composed of the driving timing of the NP field and the PN field in the driving circuit. In the NP field, the N driving is carried out with respect to the odd-numbered selection line on the scanning side, the P driving is carried out with respect to the even-numbered selection line, in the PN field, the driving operation opposite to it is carried out to apply the AC pulses necessary for the light emission with respect to all the picture elements of the thin film EL display panel. In FIG. 9, the representative example of the voltage waveforms to be applied upon the picture element A, the picture element B is shown.

Figure 4:
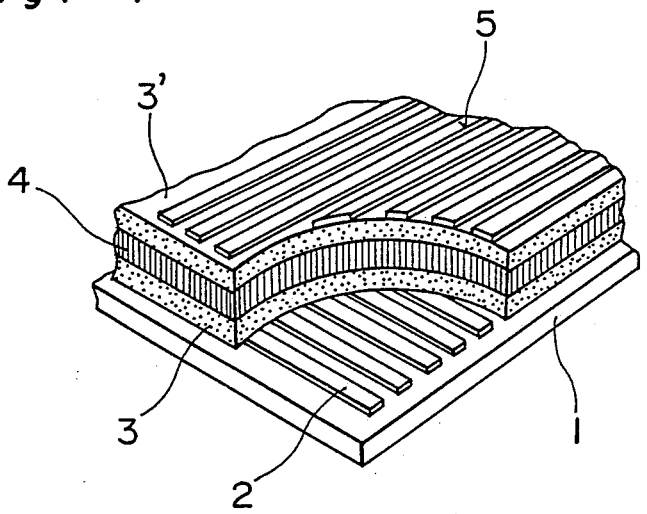
FIG. 4 is a partially notched perspective view of the thin film EL display panel.
Figure 5:
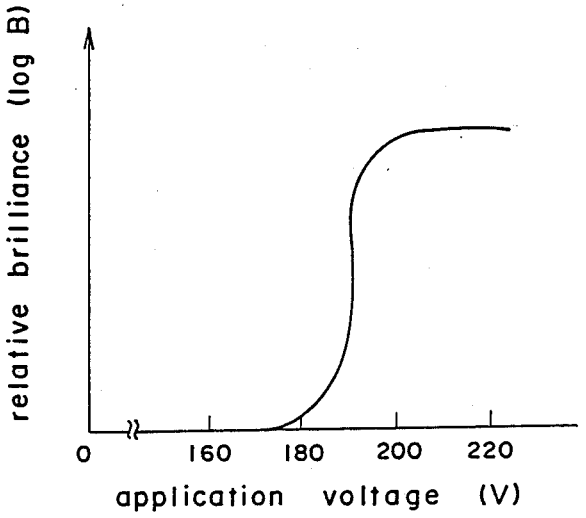
FIG. 5 is a graph showing the brightness characteristics with respect to the application voltage of the thin film EL display panel.

In the conventional driving circuit, the electric charge by the writing voltage charging operation accumulated within the EL display element after the light emission, and by the modulation voltage charging were discharged through the resistor within the driving circuit. However, in the driving apparatus in this embodiment, a driving circuit which may re-use the modulation accumulation electric-charge is used. (However, the re-use of the storing accumulation electric-charge is omitted, but may be performed in the manner similar to the re-use technique of the electric charge by the modulation voltage charging.) Accordingly, in the driving circuit, the modulation consumption power is reduced by 25% with respect to the conventional driving circuit for discharging the modulation accumulation electric-charge. The reason will be described in accordance with the model view of the circuit shown in FIG. 4.

FIG. 10(*a*) is a view, wherein the switch SWa is turned on to charge the voltage Vo (in the embodiment, equivalent to $\frac{1}{2}V_M$) into the EL display element (capacity Co). Here, reference character R shows the resistance located within the driving circuit. At this time, the energy to be accumulated in the EL display element becomes $\frac{1}{2}CoVo^2$, the energy consumed by the resistance becomes $\frac{1}{2}CoVo^2$. Then, the switch SWa is turned off in this condition to examine the energy moved into the external capacitor (capacitor C) from the EL display element when the switch SW6 has turned on to turn the condition into the balanced one. Assume that the external capacitor C has the voltage $\frac{1}{2}Vo$ charged in advance thereinto (where C>>Co).

$$\text{When } t = 0,\ q0 = CoVo \tag{1}$$

$$q = 1/2\ CVo \tag{2}$$

$$i = \frac{dq}{dt} = -\frac{dq0}{dt} \tag{3}$$

wherein i: current flowing into the circuit q0: electric charge charged into the EL display element Co q: electric charge charged into the external capacitor C from the equations (1), (2), (3), $$q0 = -q + Vo(\tfrac{1}{2}C + Co) \tag{4}$$

from the circuit equations, $$R \cdot i + q/C - q0/Co = 0 \tag{5}$$

The differential equation provided through the substitution of the equations (3), (4) into the equation (5) is solved as follows.

$$q = \frac{VoC(C + 2Co)}{2(C + Co)} - \frac{VoCCo}{2(C + Co)} \cdot e^{-\frac{C+Co}{CCoR}t}$$

from the equation (3), $$i = \frac{dq}{dt} = \frac{Vo}{2R} \cdot e^{-\frac{C+Co}{CCoR}t}$$

Energy consumed by the resistance R is $$PR = \int_0^t i^2 R dt = \frac{Vo^2 CCo}{8(C + Co)} 1 - e^{-\frac{2(C+Co)}{CCoR}t}$$

in $t \rightarrow \infty$ $$PR = \frac{Vo^2 CCo}{8(C + Co)} \approx \frac{1}{8} CoVo^2\ (C >> Co)$$

The energy remaining in the EL display element becomes $$\frac{1}{2} Co \left(\frac{Vo}{2}\right)^2 = \frac{1}{8} CoVo^2$$

because both-end voltage becomes $\frac{1}{2}Vo$. Thus, the energy (recovery energy) to be accumulated in the external capacitor C from the EL display element Co is = (energy accumulated in the EL display element *Co*)

− (energy remaining in the EL display element *Co*)

− (energy consumed in the external resistor *R*)

$$= \frac{1}{2} CoVo^2 - \frac{1}{8} CoVo^2 - \frac{1}{8} CoVo^2$$

$$= \frac{1}{4} CoVo^2$$

Accordingly, in the charging, discharging of the normal EL display element, the energy of $$\tfrac{1}{2}CoVo^2 + \tfrac{1}{2}CoVo^2 = CoVo^2$$

is required, so that 25% may be recovered.

In the present embodiment, the bi-directional switching element is connected respective with the scanning-side electrode of the thin film EL display panel 10 and the data-side electrode. The same effect is obtained even if the election charge accumulated in the EL display element is re-used through the connection of the bi-directional switching element only with the scanning-side electrode, or only with the data-side electrode, so that the summary of the present invention is not damaged.

As is clear from the present invention, according to the driving circuit of the thin film EL display panel of the present invention, the high withstand-voltage driver IC which is composed of the bi-directional switching element having the push pull function is connected with both or one of the scanning-side electrode and the data-side electrode of the EL display apparatus. The bi-directional switching circuit for applying the writing voltage or the modulation voltage is applied with the pull up common line of each of the drivers IC and the pull down common line. As a switch for externally drawing out, after the thin film EL element has emitted its light, the electric charge accumulated on the thin film EL display element, and a capacitor for accumulating the drawn out electric charge are disposed in the bi-directional switching circuit, the modulation accumulation electric charge accumulated on the film EL display element after the light emission is accumulated on the capacitor, so that the modulation consumption power occupying the majority (about 70 percent) of the driving power without the damages to the conventional advantages may be reduced by 25% as compared with the conventional driving. Also, as the similar method may be used even about the storing energy, the storing consumption power may be reduced by 25%, thus saving the considerable amount of consumption power.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A driving circuit for an electroluminescent (EL) matrix display panel wherein an EL layer is disposed between orthogonally arranged scanning electrodes and the data electrodes, comprising:

a first switching circuit for selectively applying negative or positive-polarity driver output voltages to the scanning electrodes;

a second switching circuit for supplying charging and discharging modulation driver output voltages to the data electrodes;

said first and second switching circuits each including a plurality of first, second high withstand-voltage drivers having push/pull functions, said drivers including a high level drive voltage input, a low level drive voltage input, a single control voltage input, each said driver selecting one of said drive voltage inputs for supply as said driver output voltage;

a third switching circuit for switching between a negative polarity writing voltage and 0V and connected with the low level drive voltage input of each said driver of said first switching circuit for pull down use of the first high withstand-voltage driver in the first switching circuit;

a fourth switching circuit for switching between a positive-polarity of writing voltage and 0V and connected with the high level drive voltage input of each said driver of said first switching circuit for pull up use;

the low level drive voltage input of each said driver of said second switching circuit being for pull down use and being connected with 0V; and a fifth switching circuit for switching the high level drive voltage input of said second switching circuit between a floating, level and into the modulation voltage $V_M$.

2. A driving circuit for an electroluminescent (EL) matrix display panel wherein an EL layer is disposed between orthogonally arranged scanning electrodes and data electrodes, comprising:

a first switching circuit for selectively applying negative or positive-polarity driver output voltages to the scanning electrodes;

a second switching circuit for supplying charging and is charging modulation driver output voltages to the data electrodes;

said first and second switching circuits each including a plurality of high withstand-voltage drivers having push pull functions, said drivers including a high level drive voltage input, a low level drive voltage input, a single control voltage input, each said driver selecting one of said drive voltage inputs for supply as said driver IC output voltage;

a third switching circuit for switching between the negative polarity of writing voltage, the ½ modulation voltage and 0V and connected with the low level drive voltage input of each said driver of said first switching circuit for pull down use of the high withstand-voltage driver in the first switching circuit;

a fourth switching circuit for switching between a sum of a positive polarity of writing voltage and the ½ modulation voltage, and the ½ modulation voltage and connected with the high level drive voltage input of each said driver of said first switching circuit for pull up use, the low level drive voltage input of each said driver of said second switching circuit being for pull down use and being connected with 0V;

a fifth switching circuit for switching the high level drive voltage input of said second switching circuit between a floating level and the ½ modulation voltage; and a sixth switching circuit for doubling a ¼ modulation voltage to develop the ½ modulation voltage for supply to the third, fourth, fifth switching circuits.

3. The driving circuit of claim 1 or 2, comprising, a bidirectional switch connected to one of said drive voltage inputs of at least some of said drivers for externally recovering, after the light-emission of the EL display, electric charge accumulated upon the EL display, and a capacitor for accumulating the recovered electric charge for later use in again driving the display.

4. A drive system for an electroluminescent (EL) matrix display panel including a plurality of scanning electrodes and a plurality of data electrodes extending orthogonally of each other across respective sides of an electroluminescent material, said scanning electrodes and said data electrodes forming picture elements at each intersection therebetween, said scanning electrodes arranged into odd and even groups, said drive system comprising:

scanning drive means arranged for connection with said scanning electrodes for sequentially supplying said scanning electrodes with write voltage pulses, said scanning drive means driving said odd and even scanning electrodes in first and second fields, said odd scanning electrodes being driven with a positive write voltage during the first field and a negative write voltage during the second field, said even scanning electrodes being driven with a negative write voltage during the first field and the positive write voltage during the second field;

data drive means arranged for connection with said data electrodes for selectively charging or discharging each said data electrode with a modulation voltage to selectively develop a net voltage between a said scanning electrode supplied a write voltage and each said selected data side electrode to selectively color the picture elements formed at the intersections thereof;

said scanning drive means including a pull up-pull down circuit associated with each said scanning electrode, said pull up-pull down circuit supplying one of two drive voltages supplied to said circuit to its associated scanning electrode in response to a single voltage input.

5. The system of claim 4 wherein said data drive means includes a pull up-pull down circuit associated with each said data electrode, said pull up-pull down circuit supplying one of two drive voltages supplied to said circuit to its associated data electrode in response to a single voltage input.

6. The system of claim 4 wherein each said pull up-pull down circuit includes, a high level drive voltage input, a low level drive voltage input, a single control voltage input, a bidirectional switching element responsive to said single control voltage input for supplying one of said two drive voltages to an output thereof.

7. The system of claim 5 wherein each said pull up-pull down circuit includes, a high level drive voltage input, a low level drive voltage input, a single control voltage input, a bidirectional switching element responsive to said single control voltage input for supplying one of said two drive voltages to an output thereof.

8. A drive system for an electroluminescent (EL) matrix display panel including a plurality of scanning electrodes and a plurality of data electrodes extending orthogonally of each other across respective sides of an electroluminescent material, said scanning electrodes and said data electrodes forming picture elements at each intersection therebetween, said scanning electrodes arranged into odd and even groups, said drive system comprising:

scanning drive means arranged for connection with said scanning electrodes for sequentially supplying said scanning electrodes with write voltage pulses, said scanning drive means driving said odd and even scanning electrodes in first and second fields, said odd scanning electrodes being driven with a positive write voltage during the first field and a negative write voltage during the second field, said even scanning electrodes being driven with a negative write voltage during the first field and the positive write voltage during the second field;

data drive means arranged for connection with said data electrodes for selectively charging or discharging each said data electrode with a modulation voltage to selectively develop a net voltage between a said scanning electrode supplied a write voltage and each said selected data side electrode to selectively color the picture elements formed at the intersections thereof;

charge storage device means, external of said matrix display panel for temporarily storing charge discharged from said display panel; and bidirectional switch means of selectively connecting said charge storage device means to said scanning electrode drive means or said data electrode drive means to direct charge to said charge storage device means during discharge of at least portions of said display panel and to direct charge to at least portions of said display panel when the charge stored in said charge storage means can be used to drive a portion of said display.

9. The drive system of claim 4 wherein said modulation voltage is applied to a said data electrode associated with a picture element simultaneous to the application of a said write voltage pulse to said picture element.

10. The drive system of claim 4 wherein said data drive means includes, a pair of serially connected switches, associated with each said data electrode, connected between a high level drive voltage input and a low level drive voltage input, said associated data electrode being connected between said switches, and first and second diodes, associated with each said data electrode, each connected across one of said pair of switches and being conductive in the direction opposite normal switch conduction.

11. The drive system of claim 10 wherein said data drive means further includes, a shift register serially receiving data to be displayed; and inverter means, connected between each stage of said shift register and a control terminal of each said switch to control the conduction of one switch of each switch pair to selectively supply said high level drive voltage input or low level drive voltage input to the associated data electrode.

12. The drive system of claim 11 wherein said data drive means further includes, frame switching means for supplying said modulated voltage to said data electrode during the first field and for grounding said data electrode during the second field to develop a display at a selected picture element on said data side electrode.

13. The drive system of claim 12 wherein said frame switching means comprises an exclusive OR gate inverting said data in alternate frames.

14. The drive system of claim 4 wherein each said pull up-pull down circuit of said scanning drive means includes, a pair of serially connected switches, associated with each said scanning electrode, connected between a high level drive voltage input and a low level drive voltage input, said associated scanning electrode being connected between said switches, and first and second diodes, associated with each said scanning electrode, each connected across one of said pair of switches and being conductive in the direction opposite normal switch conduction.

15. The drive system of claim 10 wherein said scanning drive means further includes, a shift register serially receiving scanning to be displayed; and inverter means, connected between each stage of said shift register and a control terminal of each said switch to control the conduction of one switch of each switch pair to selectively supply said high level drive voltage input or low level drive voltage input to the associated scanning electrode.

16. The driving circuit of claim 1 or 2 wherein each said high withstand-voltage driver is controlled by an output of a single shift register.

17. The driving system of claim 4 wherein said single voltage input of the pull up-pull down circuit associated with each said scanning electrode is developed by an output of a single shift register, said single voltage input of the pull up-pull down circuit associated with each even scanning electrode being developed by an output of a single shift register.

* * * * *